US011852133B2

(12) United States Patent
Gable et al.

(10) Patent No.: US 11,852,133 B2
(45) Date of Patent: Dec. 26, 2023

(54) WELL SERVICE PUMP POWER SYSTEM AND METHODS

(71) Applicant: AMERIFORGE GROUP INC., Houston, TX (US)

(72) Inventors: Tom Gable, Houston, TX (US); Garrett Smith, Houston, TX (US); Shelton Burnett, Houston, TX (US); John Fischer, Houston, TX (US)

(73) Assignee: AMERIFORGE GROUP INC., Houston, TX (US)

( * ) Notice: Subject to any disclaimer, the term of this patent is extended or adjusted under 35 U.S.C. 154(b) by 36 days.

(21) Appl. No.: 16/396,002

(22) Filed: Apr. 26, 2019

(65) Prior Publication Data

US 2019/0331117 A1 Oct. 31, 2019

Related U.S. Application Data

(60) Provisional application No. 62/664,078, filed on Apr. 27, 2018.

(51) Int. Cl.
*F04B 49/20* (2006.01)
*E21B 43/12* (2006.01)
(Continued)

(52) U.S. Cl.
CPC ..... *F04B 49/20* (2013.01); *E21B 43/129* (2013.01); *F04B 9/10* (2013.01); *F04B 17/03* (2013.01);
(Continued)

(58) Field of Classification Search
CPC ..... F04B 17/03; F04B 17/05; F04B 17/06; F04B 47/04; F04B 49/065; F04B 49/20;
(Continued)

(56) References Cited

U.S. PATENT DOCUMENTS 2,766,701 A * 10/1956 Giraudeau ..... F04B 53/162 417/568
3,773,438 A * 11/1973 Hall ..... E21B 43/26 417/345
(Continued)

FOREIGN PATENT DOCUMENTS

WO WO 2018/044307 3/2018

OTHER PUBLICATIONS

International Preliminary Report on Patentability issued in International application No. PCT/US2019/029477 dated Oct. 27, 2020.
(Continued)

*Primary Examiner* — Alexander B Comley
(74) *Attorney, Agent, or Firm* — Norton Rose Fulbright US LLP

(57) ABSTRACT

A well service pump system supplies high pressure working fluid to a well. The pump system is a linear design which incorporates an electric motor, a variable frequency drive (VFD), a pump drive, closed loop variable flow rate hydraulic pumps, hydraulic ram cylinders, working fluid end cylinders, and a coupling to connect the hydraulic ram cylinders and the working fluid end cylinders. The electric motor powers the hydraulic system which, in turn, provides hydraulic fluid to operate the hydraulic ram cylinders. The VFD is connected to a single one of the hydraulic pumps at a time and applies power to the connected pump, via the pump drive, to drive the connected pump from a cold start to an operating speed. The VFD is connected sequentially, one pump at a time, to each of the hydraulic pumps and disconnected from each pump once the pump reaches the operating speed. Once the pump reaches operating speed, the pump is connected to receive power directly to the electric motor.

14 Claims, 11 Drawing Sheets

(51) Int. Cl.

| | |
|---|---|
| ***F04B 17/06*** | (2006.01) |
| ***F04B 23/06*** | (2006.01) |
| ***F04B 9/10*** | (2006.01) |
| ***F04B 17/03*** | (2006.01) |
| ***F04B 47/04*** | (2006.01) |
| ***E21B 44/00*** | (2006.01) |

(52) U.S. Cl.
CPC ..... *F04B 17/06* (2013.01); *F04B 23/06* (2013.01); *F04B 47/04* (2013.01); *E21B 44/005* (2013.01)

(58) Field of Classification Search
CPC ..... F04B 13/12–14; F04B 15/02; F04B 23/04–14; F04B 25/16; F04B 41/06; E21B 43/26
USPC ..... 417/2–7
See application file for complete search history.

(56) References Cited

U.S. PATENT DOCUMENTS 3,792,939 A 2/1974 Zalis
3,847,511 A 11/1974 Cole
3,967,542 A 7/1976 Hall et al.
4,269,569 A 5/1981 Hoover
4,470,771 A 9/1984 Hall
5,246,355 A 9/1993 Matzner et al.
5,259,731 A * 11/1993 Dhindsa ..... F04B 49/065 417/3
5,385,452 A 1/1995 Lyday
5,422,550 A * 6/1995 McClanahan ..... H02P 5/50 318/103
5,522,707 A * 6/1996 Potter ..... B23Q 11/1038 417/4
5,839,888 A 11/1998 Harrison
5,846,056 A * 12/1998 Dhindsa ..... F04B 23/06 417/44.2
6,579,067 B1 * 6/2003 Holden ..... F04B 41/06 417/2
6,659,726 B2 * 12/2003 Holden ..... F04C 28/08 417/2
6,827,479 B1 12/2004 Xia et al.
7,845,413 B2 12/2010 Shampine et al.
8,789,601 B2 * 7/2014 Broussard ..... E21B 43/26 166/308.1
9,121,257 B2 9/2015 Coli et al.
9,121,397 B2 9/2015 Marica
9,395,049 B2 7/2016 Vicknair et al.
9,410,410 B2 * 8/2016 Broussard ..... F01D 15/10
9,611,728 B2 4/2017 Oehring
9,650,871 B2 5/2017 Oehring et al.
9,650,879 B2 5/2017 Broussard et al.
9,664,420 B2 * 5/2017 Bittner ..... F25B 25/005
9,745,840 B2 8/2017 Oehring et al.
9,893,500 B2 2/2018 Oehring et al.
9,920,774 B2 3/2018 Ghasripoor et al.
9,970,278 B2 5/2018 Broussard et al.
10,020,711 B2 7/2018 Oehring et al.
10,036,238 B2 7/2018 Oehring
10,119,381 B2 11/2018 Oehring et al.
2004/0167738 A1 8/2004 Miller
2008/0008606 A1 1/2008 Muth et al.
2011/0286866 A1 11/2011 Hancock, Sr.
2012/0224977 A1 * 9/2012 Sotz ..... F04B 47/04 417/18
2012/0255734 A1 * 10/2012 Coli ..... F04B 47/02 166/305.1
2015/0027712 A1 * 1/2015 Vicknair ..... F17D 1/08 166/305.1
2015/0204322 A1 7/2015 Iund et al.
2015/0211512 A1 * 7/2015 Wiegman ..... F04B 23/06 417/2
2015/0252661 A1 9/2015 Glass
2016/0105022 A1 * 4/2016 Oehring ..... H02J 9/066 700/293
2016/0258267 A1 9/2016 Payne et al.
2016/0348479 A1 12/2016 Oehring et al.
2017/0051732 A1 * 2/2017 Hemandez ..... F04B 17/03
2017/0218727 A1 * 8/2017 Oehring ..... F02M 37/32
2017/0222409 A1 * 8/2017 Oehring ..... E21B 43/26
2017/0302135 A1 * 10/2017 Cory ..... E21B 43/267
2018/0156210 A1 * 6/2018 Oehring ..... F01D 15/10
2018/0223831 A1 * 8/2018 Zhang ..... F04B 9/02
2018/0266412 A1 * 9/2018 Stokkev ..... F04B 49/08
2019/0010793 A1 1/2019 Hinderliter
2019/0120024 A1 * 4/2019 Oehring ..... E21B 41/0092
2019/0162061 A1 * 5/2019 Stephenson ..... F04B 17/03

OTHER PUBLICATIONS

International Search Report and Written Opinion issued in Corresponding International Patent Application No. PCT/US2019/029477, dated Jul. 11, 2019.
Wehr Oil & Gas, QWS 2500SD, http://www.weiroilandgas.com/products_services/well_service_stimulation/well_service-stimulation_pumps/qws_2500sd.aspx?tab=features, Accessed: Sep. 14, 2015.
Wehr Oil & Gas, TWS 2500, http://www.weiroilandgas.com/products_services/well_service_stimulation/well_service-stimulation_pumps/destiny%E2%84%A2_tws_2500.aspx?tab=downloads, Accessed: Sep. 14, 2015.

* cited by examiner

WELL SERVICE PUMP POWER SYSTEM AND METHODS

CROSS-REFERENCE TO RELATED APPLICATIONS

This application claims priority to U.S. Provisional Application No. 62/664,078, filed Apr. 27, 2018, the entire contents of which application are specifically incorporated by reference herein without disclaimer.

BACKGROUND

1. Field of Invention

The present invention relates generally to power systems for pumping assemblies used for well servicing applications, most particularly powering pumping assemblies used for well fracturing operations with an electric motor and a variable frequency drive (VFD).

2. Description of Related Art

Oil and gas wells require services such as fracturing, acidizing, cementing, sand control, well control and circulation operations. All of these services require pumps for pumping fluid down the well. The type of pump that has customarily been used in the industry for many years is a gear driven plunger type, which may be referred to as a "frac pump." The pump is often powered by a diesel engine, typically 2,000 bhp or larger, that transfers its power to a large automatic transmission. The automatic transmission then transfers the power through a large driveline, into a gear reduction box mounted on the frac pump. The frac pump has a crankshaft mounted in a housing. A plunger has a crosshead that is reciprocally carried in a cylinder perpendicular to the crankshaft. A connecting rod connects each eccentric portion or journal of the crankshaft to the plunger. The driveline enters the frac pump at a right angle to the connecting rods, plungers and pump discharge. A typical pump might be, for example, a triplex type having three cylinders, three connecting rods, and three journals on the crankshaft. An example of a common type of a well service pump (e.g., plunger pump) is disclosed in U.S. Pat. No. 2,766,701 to Giraudeau. These pumps will typically be mounted on a trailer or skid back-to-back.

Some frac pumps use an electric motor to supply power to the frac pump instead of a diesel engine. While an electric motor is more efficient in supplying power to the frac pump and does not need to be refueled, the electric motor requires a plurality of variable frequency drive (VFD) to vary the motor speed for different power applications, specifically supplying power to each of the hydraulic pumps of the frac pump. Each VFD can control the amount of current and/or voltage supplied to the electric motor to ensure that maximum current is not always applied to the motor, thereby increasing the life of the motor. Supplying the maximum horsepower of the motor is not needed for all power applications, especially when starting up a hydraulic pump from a resting position to a threshold operating speed. In current electric motor frac pumps, each hydraulic pump requires its own VFD. However, using multiple VFDs increases the cost and complexity of the frac pump.

For these and other reasons, a need continues to exist for improvements in oil and gas well servicing pumps of the type under consideration.

SUMMARY

The present disclosure includes embodiments of pump systems and methods.

In some embodiments of the present disclosure, a system for powering a pump includes a plurality of hydraulic pumps; an electric motor configured to power the plurality of pumps; a variable frequency drive (VFD) configured to be coupled to the electric motor to control an amplitude of power provided by the electric motor to the plurality of pumps; and a control system configured to control, for each of the plurality of pumps, the VFD between: a first state, wherein the pump is powered by the electric motor and the amplitude of power provided by the electric motor to the pump is controlled by the VFD; and a second state, wherein the pump is powered by the electric motor and the amplitude of power provided by the electric motor to the pump is not controlled by the VFD. In some embodiments, the electric motor is a fixed speed electric motor. In some embodiments, the system further includes at least one electric generator coupled to the electric motor.

In some embodiments, the control system includes, for each of the plurality of pumps, an electric circuit having: a VFD flow path that, in the first state, allows the VFD to control the amplitude of power provided by the electric motor to the pump; and a bypass flow path that, in the second state, allows the electric motor to provide power to the pump directly. In some embodiments, the electric circuit includes a plurality of switches actuatable to selectively permit electricity to flow through the VFD flow path and the bypass flow path. In some embodiments, the control system is configured to control, for each of the plurality of pumps, the plurality of switches. In some embodiments, at least one of the plurality of switches is operated between: an ON state that permits electricity to flow between the VFD and the pump; and an OFF state that blocks electricity flow between the VFD and the pump. In some embodiments, the hydraulic pumps are variable flow rate pumps.

In some embodiments, the pumps are fixed displacement pumps. In some embodiments, the hydraulic pumps are coupled to a pump drive and a plurality of ram cylinders. In some embodiments, each of the hydraulic ram cylinders is coupled to a respective one of the plurality of pumps. In some embodiments, each of the hydraulic ram cylinders and the electric motor are disposed on a first vehicle. In some embodiments, the VFD is disposed on a second vehicle.

In some embodiments, the system further includes: at least one working fluid end cylinder having an end cylinder housing, a plunger rod configured to reciprocate in the end cylinder housing; at least one inlet check valve coupled to the end cylinder housing and at least one outlet check valve coupled to the end cylinder housing; a suction manifold having at least one fluid inlet coupled to the at least one inlet check valve; and a discharge manifold having at least one fluid outlet coupled to the at least one outlet check valve. In some embodiments, each of the hydraulic ram cylinders has a ram cylinder housing, a ram piston configured to reciprocate in the ram cylinder housing, and a piston rod coupled to the ram piston and the plunger rod of the at least one working fluid end cylinder such that the piston is actuated to move the plunger rod: in a first direction to expel working fluid from the end cylinder housing during a forward stroke of the plunger rod, and in a second direction to draw working fluid into the end cylinder housing during a return stroke of the plunger rod.

In some embodiments of the present disclosure, a method of powering a pump system includes: operating an electric motor configured to power the plurality of pumps; and operating, by a control system coupled to a variable frequency drive (VFD) and configured to control, for each of the plurality of pumps, the VFD, where the VFD is coupled to the electric motor to control an amplitude of power provided by the electric motor to the plurality of pumps. In some embodiments, the operating the VFD includes: coupling, by the control system, the VFD to one of the pumps while decoupling the VFD from the other pumps; actuating a first state, wherein the pump is powered by the electric motor and the amplitude of power provided by the electric motor to the pump is controlled by the VFD, on the one of the pumps coupled to the VFD; decoupling the VFD from the one of the pumps; actuating a second state, wherein the pump is powered by the electric motor and the amplitude of power provided by the electric motor to the pump is not controlled by the VFD; coupling the VFD to one of the other pumps; actuating the first state on the one of the other pumps coupled to the VFD; decoupling the VFD from the one of the other pumps; and actuating the second state on the one of the other pumps.

In some embodiments, actuating the first state includes actuating a VFD flow path that, in the first state, permits electricity to flow through the VFD flow path and allows the VFD to control the amplitude of power provided by the electric motor to the pump. In some embodiments, actuating the VFD flow path includes: transmitting, by the control system coupled to a plurality of switches, an ON signal to one of the switches, where each switch couples one of the pumps to the VFD; switching the one of the switches to an ON state, where the ON state connects the one of the variable flow rate pumps to the VFD; and transmitting, by the control system when the one of the switches is ON, an OFF signal to each of the other switches.

In some embodiments, actuating the second state includes actuating a bypass flow path that, in the second state, permits electricity to flow through the bypass flow path allows the electric motor to provide power to the pump directly. In some embodiments, actuating the bypass flow path includes: transmitting, by the control system, an OFF signal to the one of the switches; switching the one of the switches to an OFF state, where the OFF state disconnects the one of the pumps from the VFD; transmitting, by the control system, an ON signal to a bypass switch coupled in series between the electric motor and the one of the pumps and in parallel with the VFD; and switching the bypass switch to an ON state, where the ON state connects the one of the pumps to the electric motor.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), "include" (and any form of include, such as "includes" and "including"), and "contain" (and any form of contain, such as "contains" and "containing") are open-ended linking verbs. As a result, an apparatus that "comprises," "has," "includes," or "contains" one or more elements possesses those one or more elements, but is not limited to possessing only those elements. Likewise, a method that "comprises," "has," "includes," or "contains" one or more steps possesses those one or more steps, but is not limited to possessing only those one or more steps.

Any embodiment of any of the apparatuses, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments described above and others are described below.

DETAILED DESCRIPTION OF ILLUSTRATIVE EMBODIMENTS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

Figure 1:
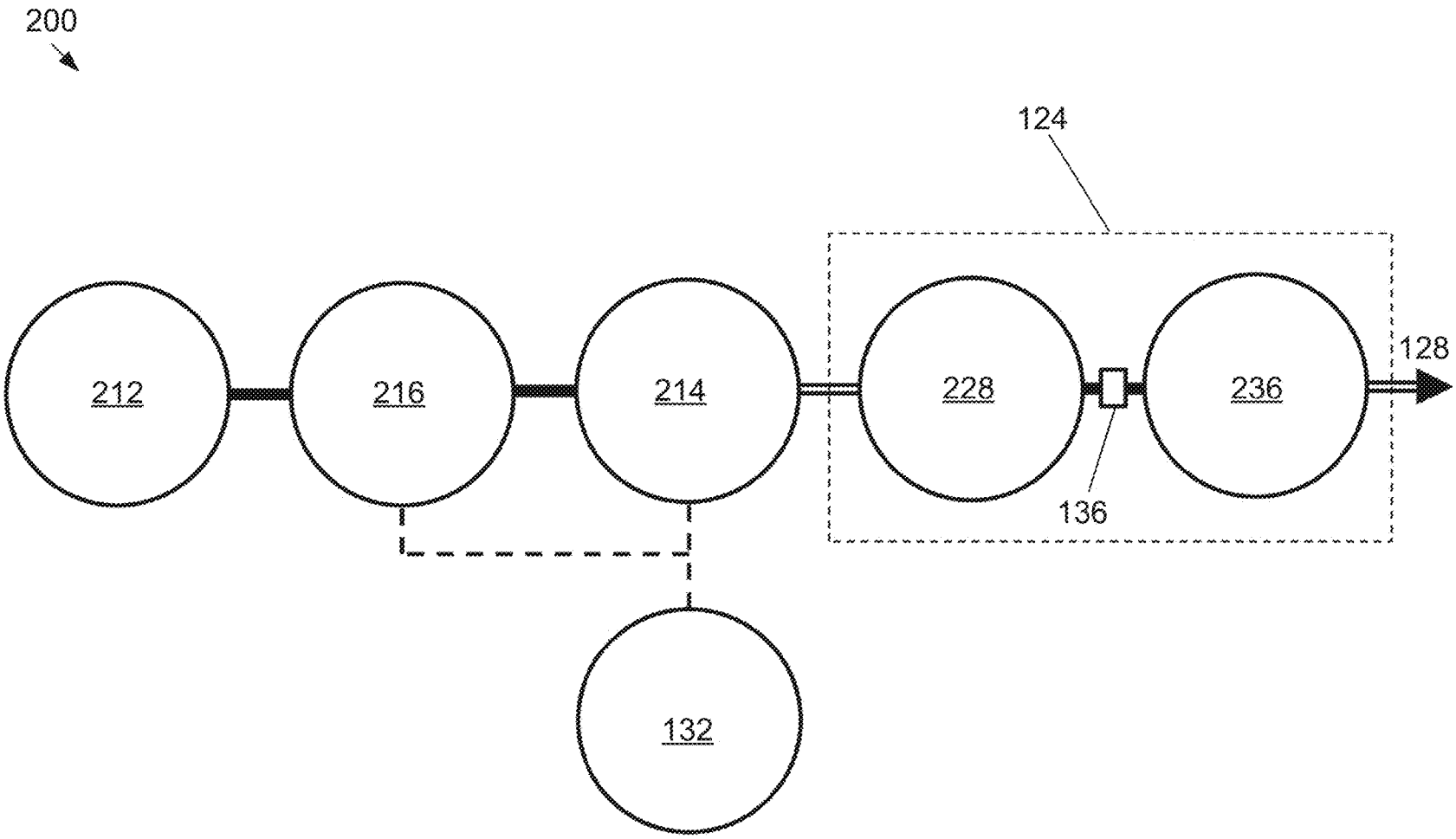
FIG. 1 is a simplified, schematic diagram of the operative components of an embodiment of the present well service pump systems.

FIG. 1 is a simplified, schematic diagram of the operative components of an embodiment of the present well service pump system 200. In the embodiment shown, system 200 includes an electric motor 212 coupled to a variable frequency drive (VFD) 216. The VFD 216 selectively couples the electric motor 212 to one of a plurality of hydraulic pumps 214 so power can be transferred from electric motor 212 to the hydraulic pumps 214. Hydraulic pumps 214 provide the driving fluid to operate the hydraulic ram cylinders 228 which, in turn, operate the fluid end cylinders 236. The hydraulic ram cylinders 228 and the fluid end cylinders 236 together comprise a working fluid pump assembly 124 to pump working fluid into a well under high pressure via outlet 128. A hydraulic control system 132 controls the supply of driving fluid to the hydraulic ram cylinders 228. In this system, the hydraulic ram cylinder piston rods and the plunger rods of the working fluid end cylinders are located in-line, in linear fashion (connected by a coupling member 136). The VFD 216 and hydraulic pumps 214 are coupled to a control system 132. The control system 132 controls the operation of the VFD 216 and controls the coupling and decoupling of the VFD 216 to and from the hydraulic pumps 214. The hydraulic pumps 214 are coupled to a working fluid pump assembly 124 that includes hydraulic ram cylinders 228 and fluid end cylinders 236 (connected together via coupling member 136) that pumps working fluid into a well under high pressure via outlet 128. The control system 132 controls the supply of driving fluid to the hydraulic ram cylinders 228 via hydraulic pumps 214.

Figure 2A:
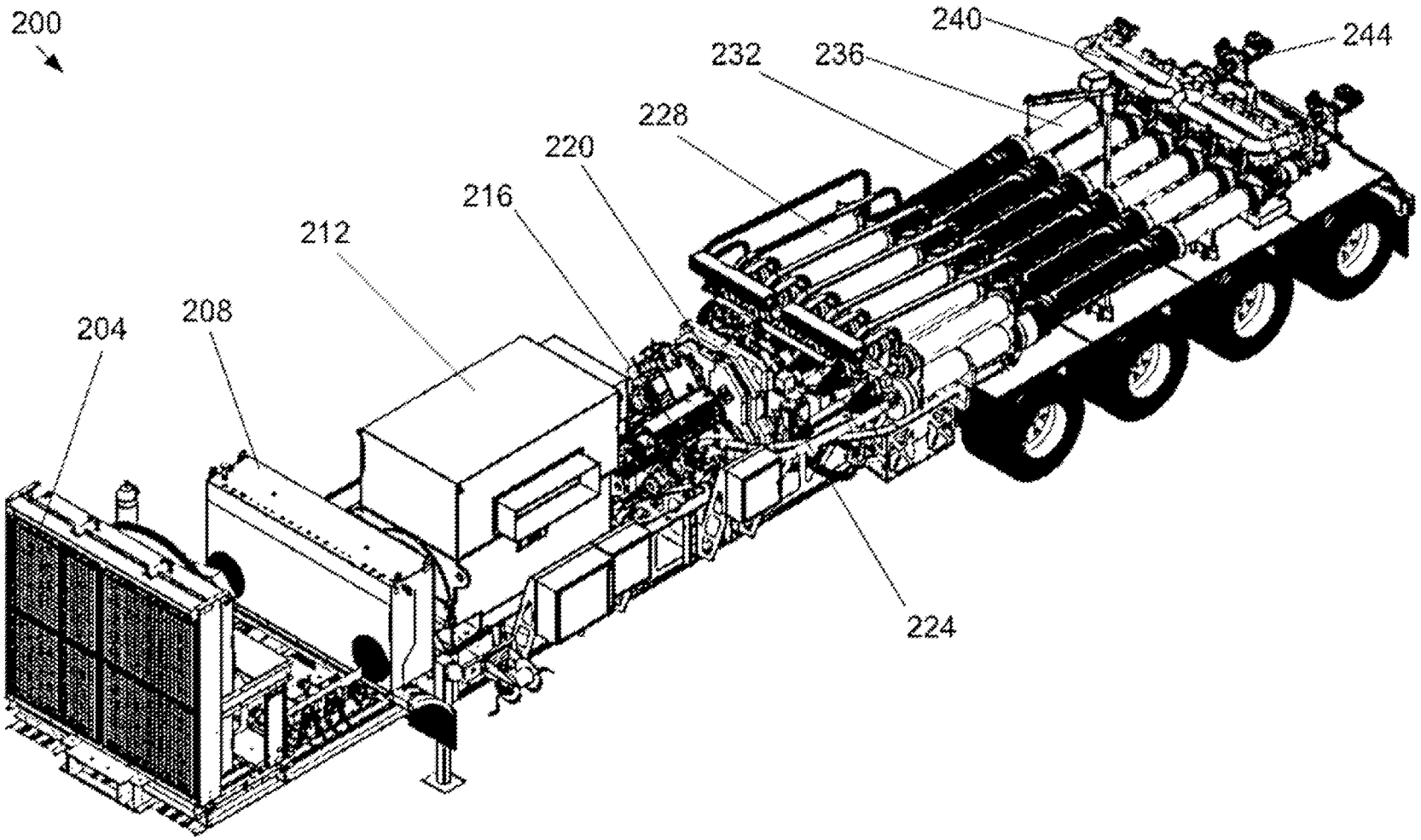
FIGS. 2A-2B depict perspective views of an embodiment of the present well service pump systems.
Figure 2B:
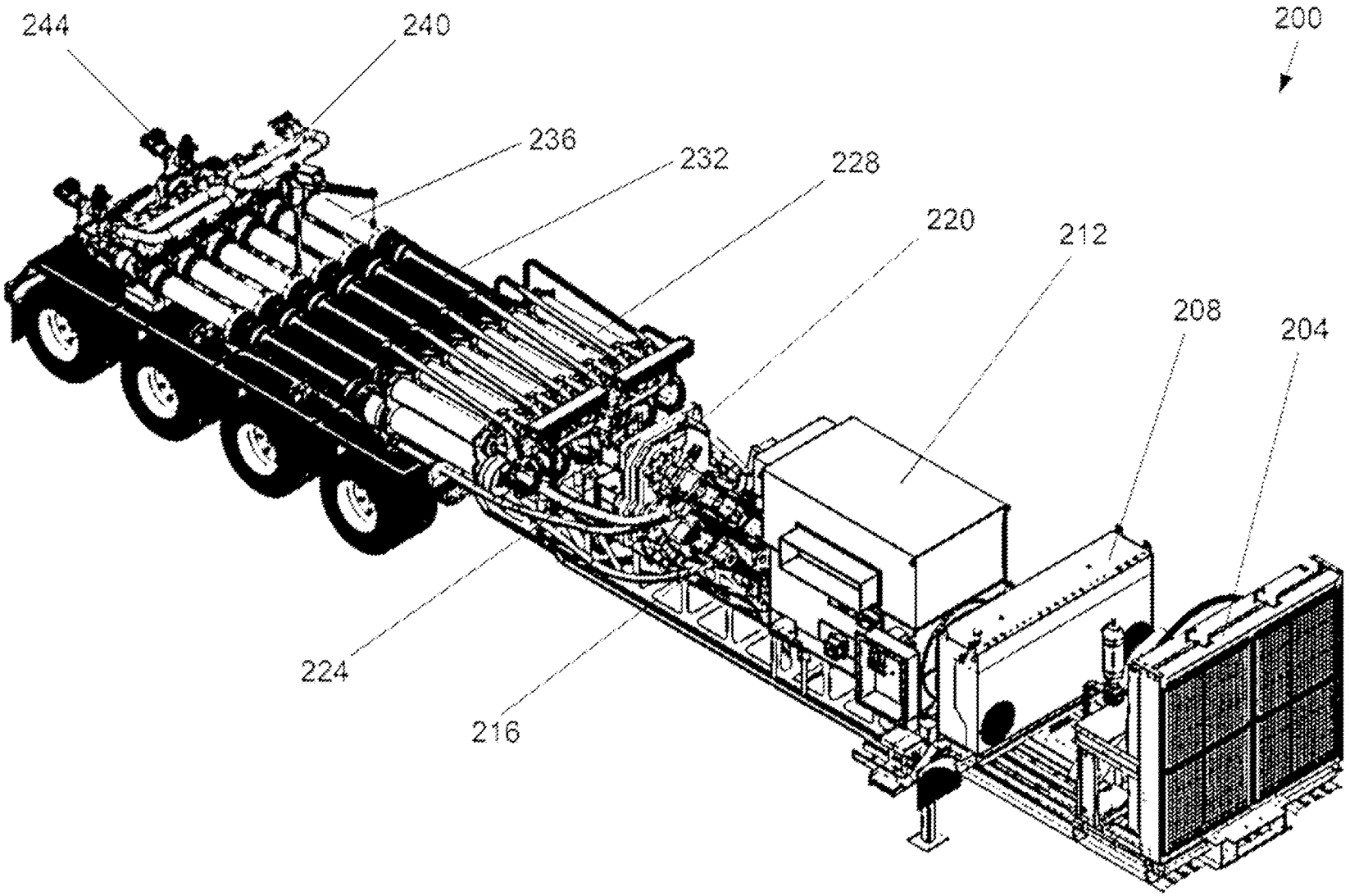
Figure 2C:
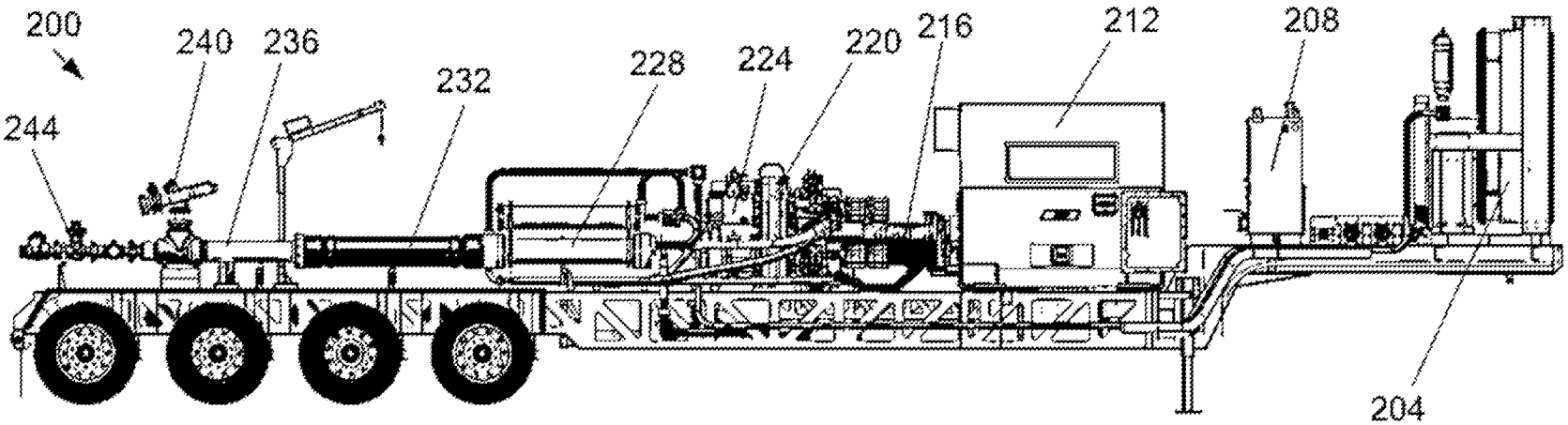
FIGS. 2C-2D depict side views of the system of FIGS. 2A-2B.
Figure 2D:
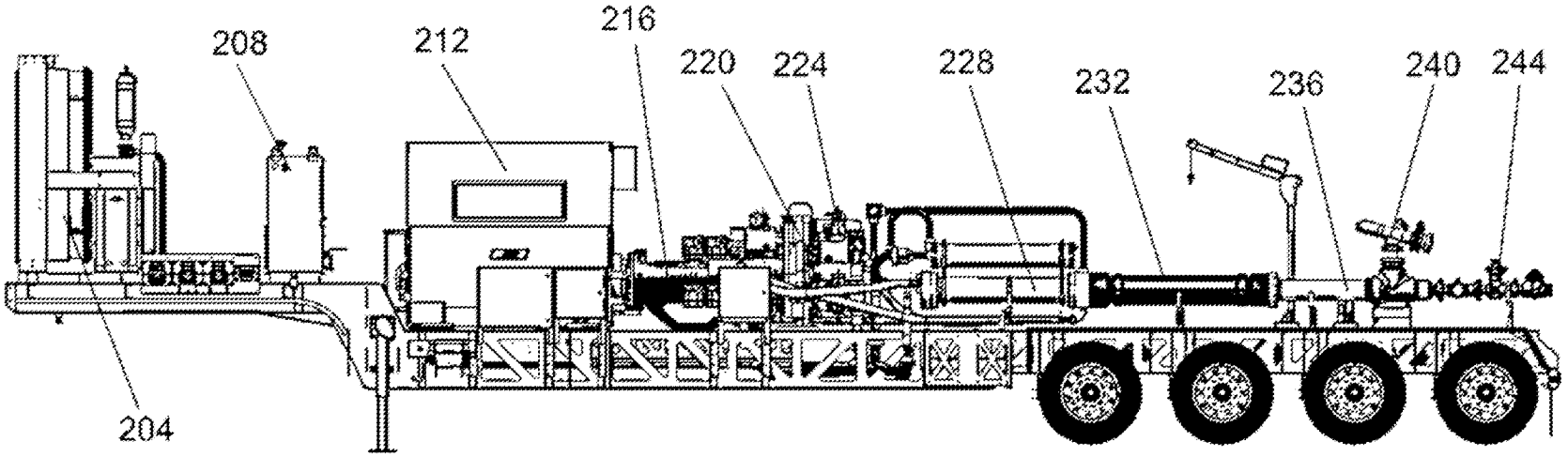

FIGS. 2A-2D depict various views of an embodiment of the present well service pump system 200. Specifically, FIGS. 2A and 2B depict perspective views and FIGS. 2C and 2D depict right and left side views, respectively. In the embodiment shown, system 200 is coupled to and carried by a trailer (e.g., a semi trailer) or other vehicle for transportation to and from job sites for fracing operations. In other embodiments, system 200 can be coupled to a skid frame that can then be loaded onto and offloaded from a trailer. The trailer shown has four axles but other axle configurations can be used (e.g., a 3-axle configuration, a lift axle). In some embodiments, the trailer is 53 feet long and weighs approximately 12,000 pounds although other suitable lengths and weights can be used.

In the embodiment shown, system 200 includes a cooler 204 coupled to a hydraulic fluid reservoir 208. In the embodiment shown, cooler 204 includes a fan and a fan motor for cooling the hydraulic fluid used in operating the pump system 200. For example, cooler 204 can remove 600 HP at 270 GPM, maintain a 125° F. inlet temperature, and have a weight of 3,991 pounds. In some embodiments, the fan motor specifications are 20 HP, 480 V, 3 φ, 22.7 A, TEFC, and 1800 RPM but other suitable fan motors can be used. Hydraulic fluid reservoir 208 stores the hydraulic fluid used to operate the pump system 200 and can be any suitable size and type. For example, hydraulic fluid reservoir 208 can be a sealed, stainless steel tank having an internal bladder that can store 400 gallons of fluid volume.

Figure 3B:
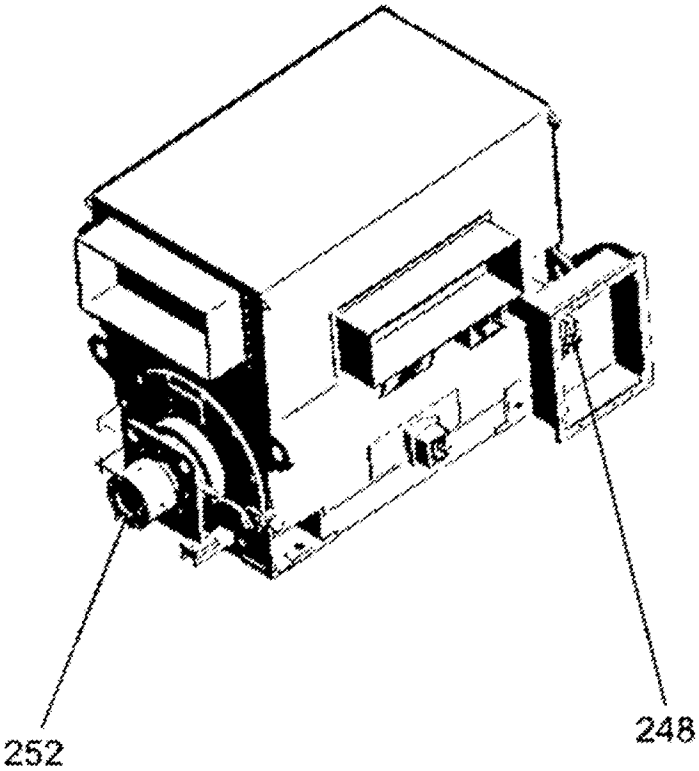
FIGS. 3A-3B depict a side view and a perspective view of an electric motor used in the system of FIGS. 2A-2B.
Figure 3A:
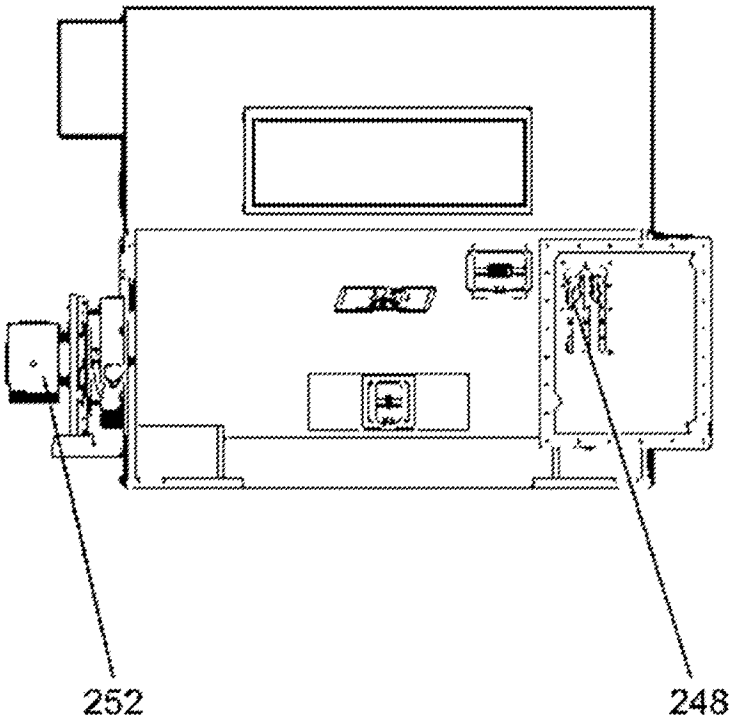

In the embodiment shown, an electric motor 212 is provided to create and supply drive power to the pump assemblies of system 200. FIGS. 3A-3B depict a side view and a perspective view of electric motor 212 used in system 200. Electric motors of various types and/or specifications can be used, such as externally commutated asynchronous or synchronous AC motors. For example, in the embodiment shown, the electric motor is a fixed speed motor with specifications of 6000 HP, 4160 or 6000 V, 3 φ, and 1800 RPM but other suitable electric motors can be used. Electric motor 212 can be coupled to one or more electric generators to provide electrical power to the motor. In the embodiment shown, the electric generator(s) are located off the trailer on a separate trailer or other mobile unit, and, in some embodiments, the electric generators can be disposed on the same trailer as electric motor 212. In the embodiment shown, the electric generators are coupled to electric motor 212 at input port 248. The power created by the electric motor is output via output port 252. In the embodiment shown, electric motor 212 is capable of providing more than twice the horsepower as comparable diesel engines. Electric motor 212 also has lower weight per horsepower, reduced noise levels, and reduced maintenance required than diesel engines.

Figure 4B:
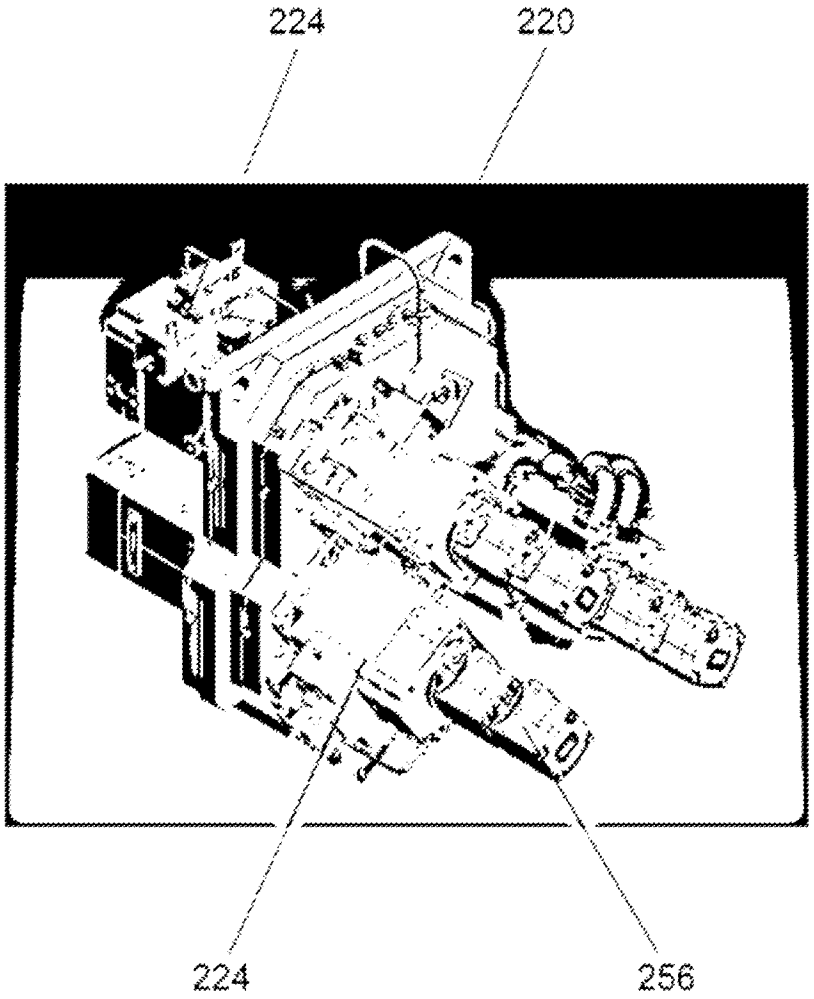
FIGS. 4A-4B depict a side view and a perspective view of a variable frequency drive (VFD) and a pump drive used in the system of FIGS. 2A-2B.
Figure 4A:
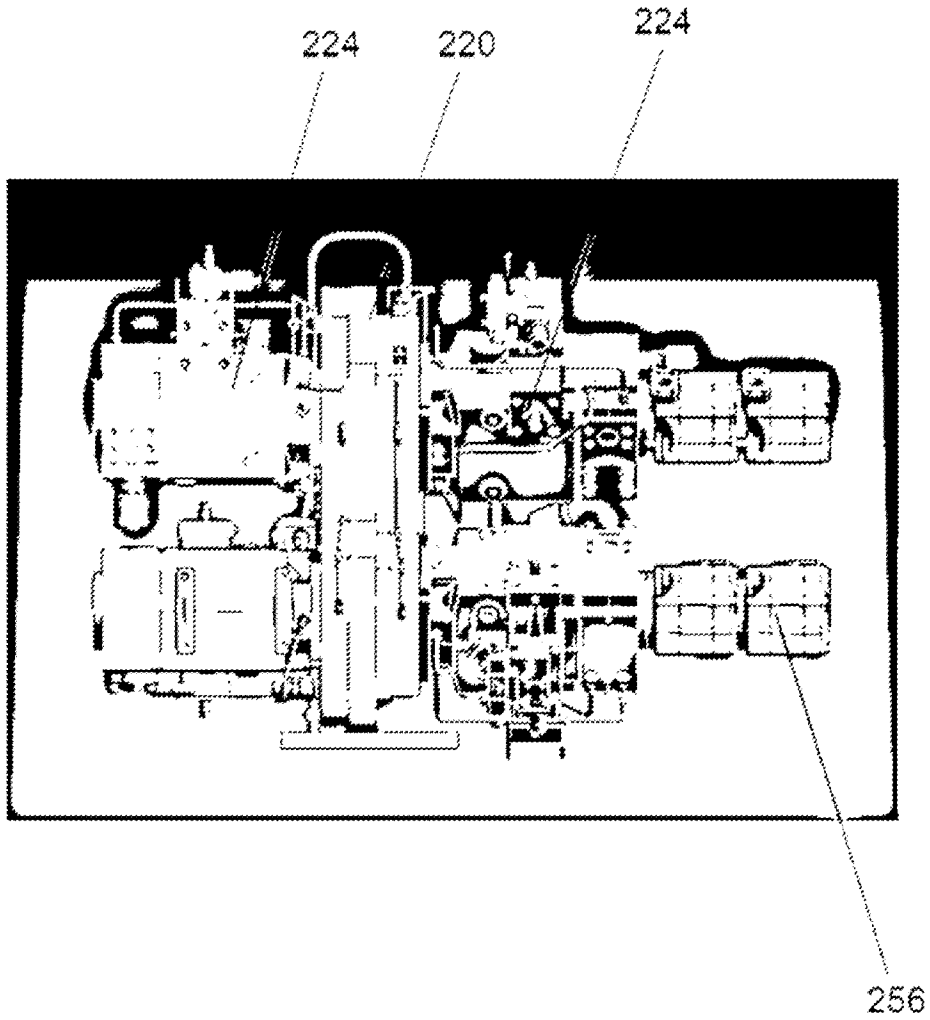

Electric motor 212 is coupled to a single variable frequency drive (VFD) 216 and a pump drive 220. FIGS. 4A-4B depict a side view and a perspective view of a variable frequency drive (VFD) and a pump drive used in the system 200. VFD 216 controls the speed at which electric motor 212 operate each pump assembly by controlling the current and/or voltage levels supplied to the electric motor. VFD 216 also optimizes the motor starting characteristics and regulates the magnetic flux of the motor such that torque and horsepower supplied by the motor can be controlled and/or maintained. Because VFD 216 increases the power factor of electric motor 212, smaller amounts of current are necessary to bring the motor up to full speed and maintain that speed. Therefore, VFD 216 can increase the life of the electric motor 212 and enable it to operate more efficiently.

In the embodiment shown, pump drive 220 supplies power from electric motor 212 to drive hydraulic pumps 224 of system 200. Pump drive 220 is coupled to hydraulic pumps 224 via a plurality of pump pads. In the embodiment shown, pump drive 220 has eight pump pads with four pads on each face of pump drive 220. The power capacity of each pump pad can be over 1200 HP although pads with other suitable power capacities can be used. Pump drive 220 supplies power to hydraulic pumps 224 at a drive speed ratio 1:1 with electric motor 212. In the embodiment shown, hydraulic pumps 224 have specifications of 750 cc, 6200 psi, 350 GPM, and 1800 RPM, although other suitable hydraulic pumps 224 can be used. In the embodiment shown, hydraulic pumps 224 are mounted directly onto pump drive 220. Hydraulic fluid can be pumped from hydraulic pumps 224 to the main well pumping assembly via hydraulic fluid outlets 256. In the embodiment shown, hydraulic pumps 224 are variable flow rate pumps enabled to permit adjustment of the rate at which hydraulic fluid is delivered to hydraulic ram cylinders 228, and thus, the rate at which the hydraulic ram cylinders are actuated. In the embodiment shown, the well pump assembly of system 200 includes hydraulic ram cylinders 228, connection cylinders 232, working fluid end cylinders 236, suction manifold 240, and discharge manifold 244.

In the embodiment shown, each hydraulic ram cylinder 228 is connected to a working fluid pump end cylinder 236. In this embodiment, working fluid pump end cylinders 236 include an end cylinder housing and a plunger rod configured to reciprocate in the end cylinder housing. In this embodiment, hydraulic ram cylinder 228 includes a ram cylinder housing and a ram piston configured to reciprocate in the ram cylinder housing. In some embodiments, each pump assembly is supported on the trailer by a plurality of vibration-dampening mounts. The piston rod is coupled to the ram piston and the plunger rod such that ram piston can be actuated to move the plunger rod in a first direction to expel working fluid from the end cylinder housing during a forward stroke of the plunger rod, and in a second direction to draw working fluid into the end cylinder housing during a return stroke of the plunger rod.

In the embodiment shown, each working fluid pump end cylinder 236 includes an inlet check valve coupled to an end cylinder housing and configured to permit working fluid to be drawn into the end cylinder housing but prevent working fluid from exiting the end cylinder housing through the inlet check valve. In operation of the system, the inlet check valve prevents working fluid from exiting through the fluid inlet thereby enabling working fluid to be pressurized in the cylinder and directed solely to the well. In this embodiment, each working fluid end cylinder 236 further includes an outlet check valve coupled to the end cylinder housing and configured to permit working fluid to exit the end cylinder housing while preventing working fluid from being drawn into the end cylinder housing. In operation of the system, the outlet check valve prevents working fluid pressurized downstream of the outlet check (e.g., in the outlet manifold described below) valve from entering the cylinder housing during the return stroke of plunger rod (e.g., during the forward stroke of other working fluid pump assemblies). The outlet check valve and inlet check valve may, in some embodiments, be at least partially in the end cylinder housing.

In the embodiment shown, system 200 further includes a suction manifold 240 coupled to the inlet check valves and inlet passages of each working fluid pump end cylinder 236; and a discharge manifold 244 coupled to the outlet check valves and outlet passages of the working fluid pump end cylinder 236. In this embodiment, suction manifold 240 includes a plurality of inlet flow channels each coupled to a different one of the working fluid pump end cylinders 236 via the corresponding inlet check valve and inlet flow channel. In this embodiment, each inlet flow channel has a cross-sectional area at least as large as the cross-sectional area of the interior of the working fluid end cylinder to which the inlet flow channel is coupled.

In the embodiment shown, system 200 also comprises a valve system coupled to the reservoir 208 via hydraulic pumps 224 and to each hydraulic ram cylinder 228 of each of the working fluid pump assemblies to direct pressurized working fluid to and from the hydraulic ram cylinders. In this embodiment, system 200 also comprises a control system 132 coupled to the valve system and configured to sequentially actuate the hydraulic ram cylinders 228 to deliver (e.g., continuous and substantially pulseless) output flow of the working fluid from the pump system to the well.

In the embodiment shown, control system 132 comprises one or more processors and/or a programmable logic controllers (PLCs) configured to sequentially actuate working fluid pump end cylinders 236 (i.e., via hydraulic ram cylinders 228). In most embodiments, the present systems are configured to actuate the pump assemblies such that at least one of the pump assemblies is performing a forward stroke at any given point in time (e.g., such that the hydraulic ram cylinder of a first one of the working fluid pump assemblies is beginning its forward stroke as the hydraulic ram cylinder of a second one of the working fluid pump assemblies is ending its forward stroke). For example, in an embodiment with only two pump assemblies, the first pump assembly would perform its forward stroke as the second pump assembly performs its return stroke of the same duration. In an embodiment with pump assemblies included in a multiple of three (e.g., six) the pump assemblies are controlled as two groups of three.

Figure 5:
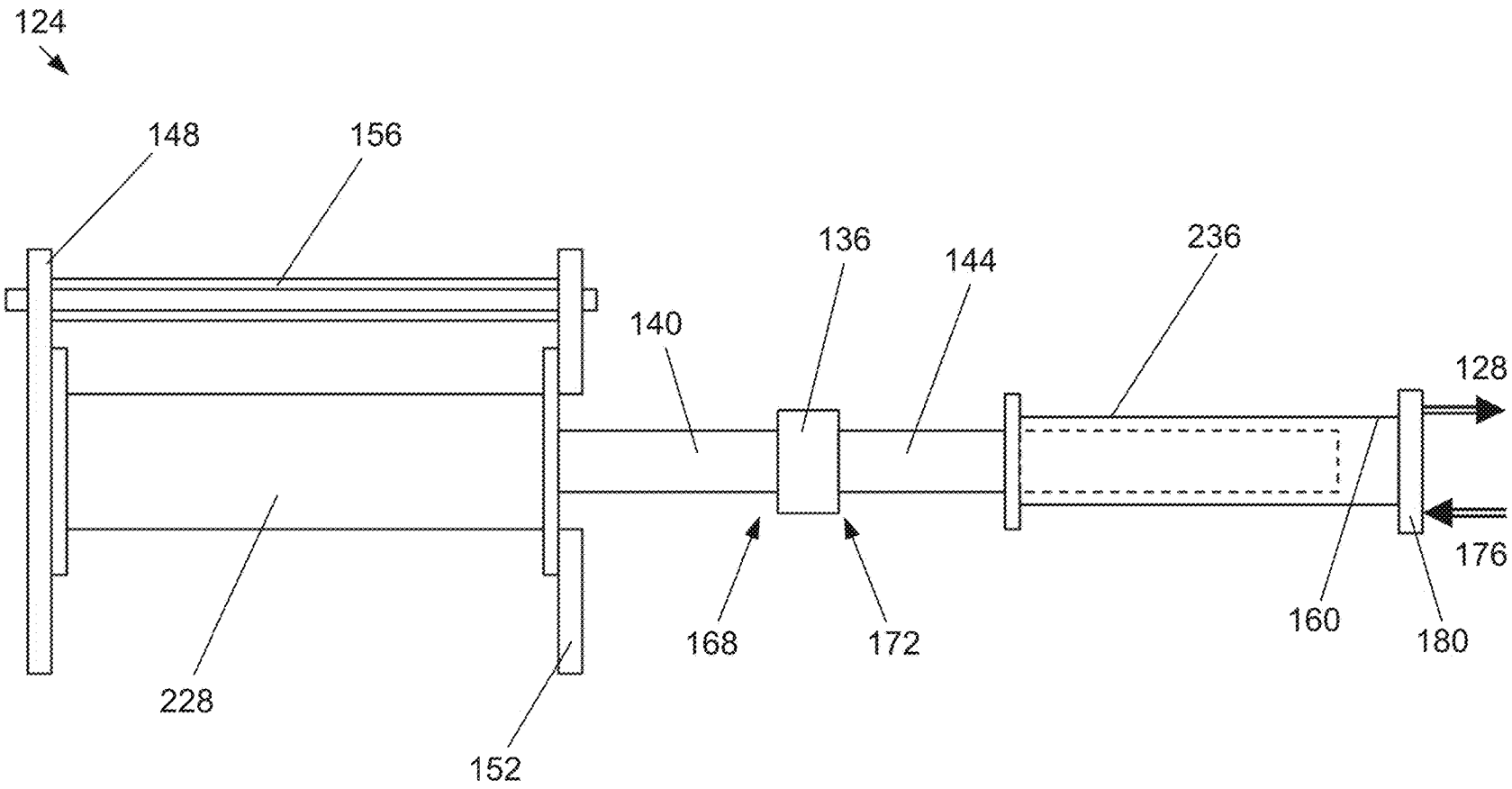
FIG. 5 is a simplified view of an in-line hydraulic cylinder, piston rod, plunger rod, and working fluid end cylinder used in the pump system of FIGS. 2A-2B.

FIG. 5 is a simplified view of the working fluid pump assembly 124 used in the pump system 200 of FIGS. 2A-2B. As shown in FIG. 5, hydraulic ram cylinder 228 has a ram piston rod 140 which is connected to operate the working fluid end cylinder 236. In the embodiment shown, the coupling member 136 is operably connected between piston rod 140 and plunger rod 144 so that the piston rod and plunger rod are arranged in an in-line, linear fashion. Each hydraulic ram fluid cylinder 228 of a system 200 can conveniently be mounted on the bed of a truck or skid by means of mounting flanges 148, 152, and stay rods 156.

As mentioned above, a valve system can be operably associated with each hydraulic ram cylinder 228 for delivering driving fluid to each hydraulic ram cylinder at a driving pressure. Control system 132 is provided for operating the valve system to alternately pressurize each hydraulic ram cylinder on a forward stroke thereof and to depressurize the hydraulic ram cylinder on a return stroke thereof to thereby deliver a continuous and pulseless output flow of the working fluid from the working fluid end cylinders to the well.

In some embodiments, the system includes a directional control valve connected to the source of driving fluid and movable between a pressurizing position which admits driving fluid for pressurizing a respective ram cylinder at the beginning of its forward stroke and for exhausting the respective ram cylinder during its return stroke. In addition to the use of directional control valves, the present systems may also include one or more proportional control valves (sometimes called proportional throttle valves). The directional control valve controls the direction of the flow of the hydraulic fluid. In one position, it allows a hydraulic ram cylinder to charge and in the other position it allows the ram piston to return. A proportional control valve component of the system can be computer controlled to provide real time, exact control of the position of the respective ram piston rod. In some embodiments, for example, this can allow the system to have one ram piston accelerating one ram half way thru its travel while another ram decelerates, to closely approximate the timing of a current crankshaft design.

Hydraulic ram cylinder 228 has an internal diameter and internal cylindrical sidewalls, a piston (not shown in FIG. 5) with an outer diameter that fits closely and in a substantially sealed relationship with the inner cylindrical sidewalls as is typical for hydraulic power cylinders, and a piston rod 140 coupled to the piston and extending out of the cylinder housing as shown. In contrast, in the embodiment shown, working fluid end cylinder 236 includes a plunger rod 144 (e.g., a plunger that is unitary with and/or has a substantially equal outer diameter to that of the plunger rod, as shown). In this embodiment, the outer diameter of plunger rod 144 is smaller than the inner diameter of the inner diameter defined by inner walls 160 of the housing of fluid end cylinder 236, as shown. As such, plunger rod 144 is received in spaced-apart fashion from walls 160 so that abrasive fluids may be pumped without undue wear on the plunger rod or cylinder walls. For example, the space between the outer surface of the plunger rod and the inner walls of the housing of end cylinder is larger than the largest expected transverse dimension of any particles in the working fluid to prevent any single particle in the working fluid from simultaneously contacting the outer surface of the plunger and the inner surface of the housing. In the embodiment shown, coupling member 136 is configured to couple a first rod end 168 of plunger rod 140 to a second rod end 172 of plunger rod 144 in order to achieve the in-line arrangement, and such that reciprocal movement of the plunder rod 140 of hydraulic ram cylinder 228 causes reciprocal movement of the plunger rod 144 of working fluid end cylinder 236. The inlet 176 and outlet 128 for the working fluid are illustrated in simplified fashion. In the embodiment shown, an in-line discharge valve 180 is provided to control the inflow and outflow of the hydraulic fluid from working fluid end cylinder 236.

Figure 6:
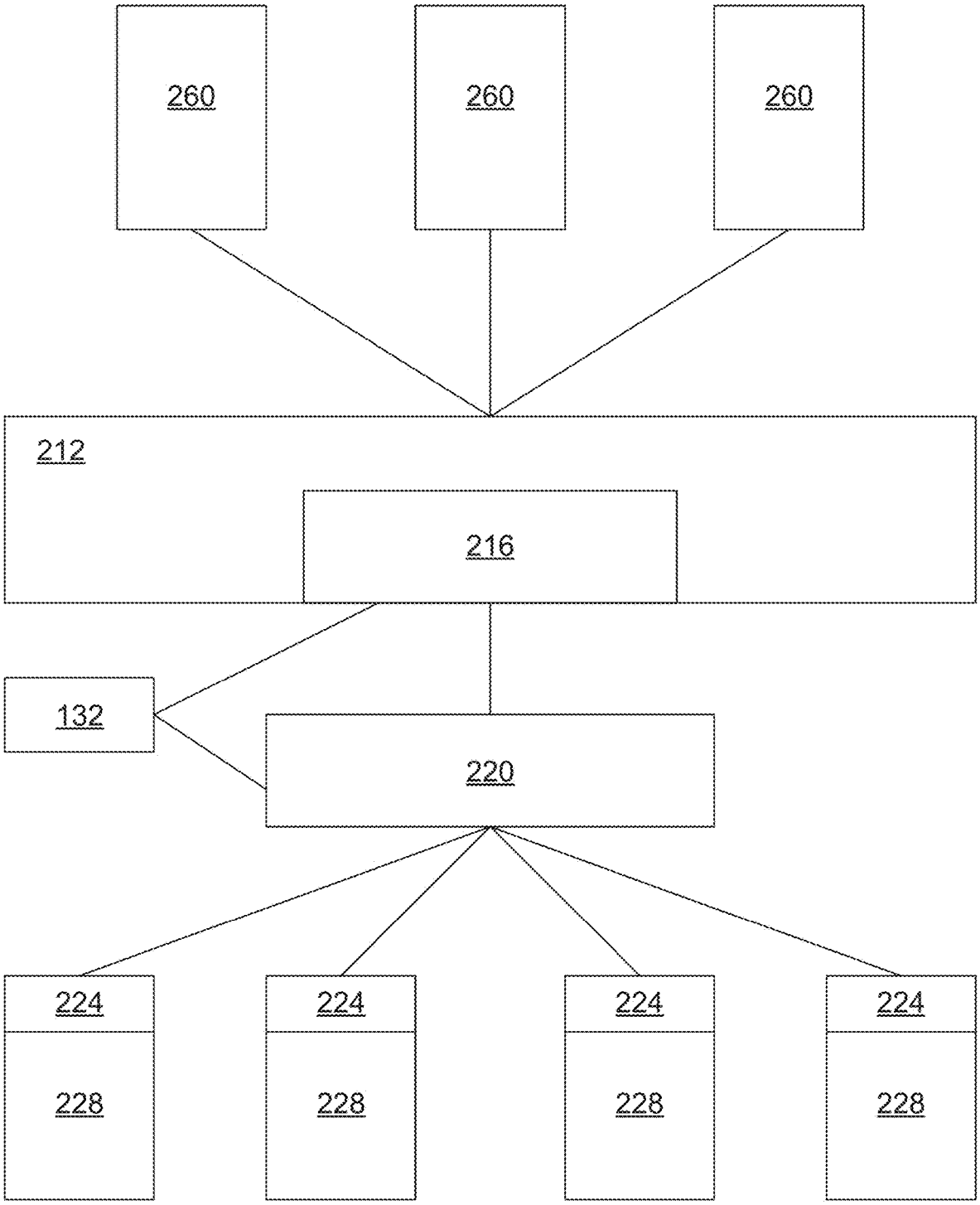
FIG. 6 depicts a simplified, schematic diagram of the operative power and control components of the system of FIGS. 2A-2B.

FIG. 6 depicts a simplified, schematic diagram of the operative power and control components of system 200. In the embodiment shown, a plurality of electric generators 260 can be coupled to electric motor 212 to supply electrical power to the electric motor. Electric generators 260 can be disposed on the same vehicle or a vehicle different from the vehicle on which electric motor 212 is disposed. VFD 216 is also coupled to electric motor 212 via one or more electric lines. In some embodiments, VFD 216 can be disposed on a trailer separate from the electric motor 212 (e.g., on the same trailer as electric generators 264) or can be disposed on the same trailer as electric motor 212. In the embodiment shown, VFD 216 regulates the power levels supplied from electric motor 212 to pump drive 220. Control system 132 is coupled to both VFD 216 and pump drive 220. Control system 132 transmits signals to VFD 216 to control the supply of power to pump drive 220 at different times and for different operation processes. For example, a soft start (i.e., ramp-up) process is used to actuate hydraulic pumps 224 from a cold state (i.e., a position at which plunger rod 144) to an operating state wherein the pumps are running at a threshold speed to actuate the pumping assembly. When a soft start process is needed to be performed on hydraulic pumps 224, control system 132 transmits signals to VFD 216 to regulate the amount of power supplied from electric motor 212.

Control system 132 is also coupled to pump drive 220. In the embodiment shown, pump drive 220 is directly coupled to each of hydraulic pumps 224 and is configured to selectively supply power to each hydraulic pump 224. Pump drive 220 includes a plurality of switches that can be toggled between an "ON" and "OFF" state to permit and block a hydraulic pump 224 from receiving power from motor 212 via VFD 216. In the embodiment shown, VFD 216 is a single VFD that regulates power for all the hydraulic pumps via pump drive 220. This single VFD configuration saves costs by eliminating the need for each hydraulic pump to be regulated by its own VFD. When performing a slow start process on hydraulic pumps 224, control system 132 toggles the plurality of switches in such a way as to connect a single hydraulic pump 224 to pump drive 220 and VFD 216 at a time while leaving the other hydraulic pumps connected to the pump drive unaffected. Control system 132 can toggle the switches in a sequential fashion such that the VFD 216 ramps up the speed of a first hydraulic pump 224, and, after the connected hydraulic pump 224 reaches operating speed, the VFD is operably disconnected from the first pump and the VFD is operably connected to a second hydraulic pump 224 and the ramp-up/disconnect procedure is repeated for the second pump. The ramp-up/disconnect procedure can be repeated any number of times for any suitable number of pumps 224. The sequential fashion can constitute connecting the hydraulic pumps in a sequential order from right to left or left to right as disposed on the trailer. The sequential fashion can also constitute connecting the hydraulic pumps in a random order. Once the hydraulic pump is up to operating speed and disconnected from VFD 216, it is directly connected to electric motor 212 via pump drive 220 to receive power at a constant rate sufficient to maintain the threshold operating speed.

In the embodiment shown, system 200 includes one or more sensors that monitor the speed of the hydraulic pumps 224. The sensor(s) of the present systems (e.g., 200) can comprise any suitable sensor, such as, for example, a pump speed sensor, current sensor, voltage sensor, and/or the like that is capable of sensing a power state and/or a speed of the hydraulic pumps 224. By way of example, in the embodiment shown, the sensor(s) may be configured to capture data indicative of parameters such as pressure, flow rate, temperature, and/or the like of hydraulic fluid within the hydraulic pumps 224. The sensor(s) may also be configured to capture data indicative of parameters such as the amount of current, voltage, and/or the like supplied to the electric motor. Data captured by the sensor(s) may be transmitted to control system 132. In some embodiments, a system (e.g., 200) may include a memory configured to store data captured by the sensor(s).

In the embodiment shown, control system 132 includes at least one processor configured to control VFD 216 and pump drive 220. For example, in the depicted embodiment, the processor(s) may transmit commands to VFD 216 to regulate electric motor 212 to supply power to pump drive 220 and a particular hydraulic pump 224 at levels to efficiently and safely perform a soft start process on hydraulic pump 224. Similarly, the processor(s) may transmit commands to the switching components of pump drive 220 to couple and decouple the hydraulic pumps 224 from the electric motor 212 and VFD 216. In the depicted embodiment, control of the switching components of pump drive 220 by the processor(s) may be facilitated by data captured by the sensor(s).

Figure 7:
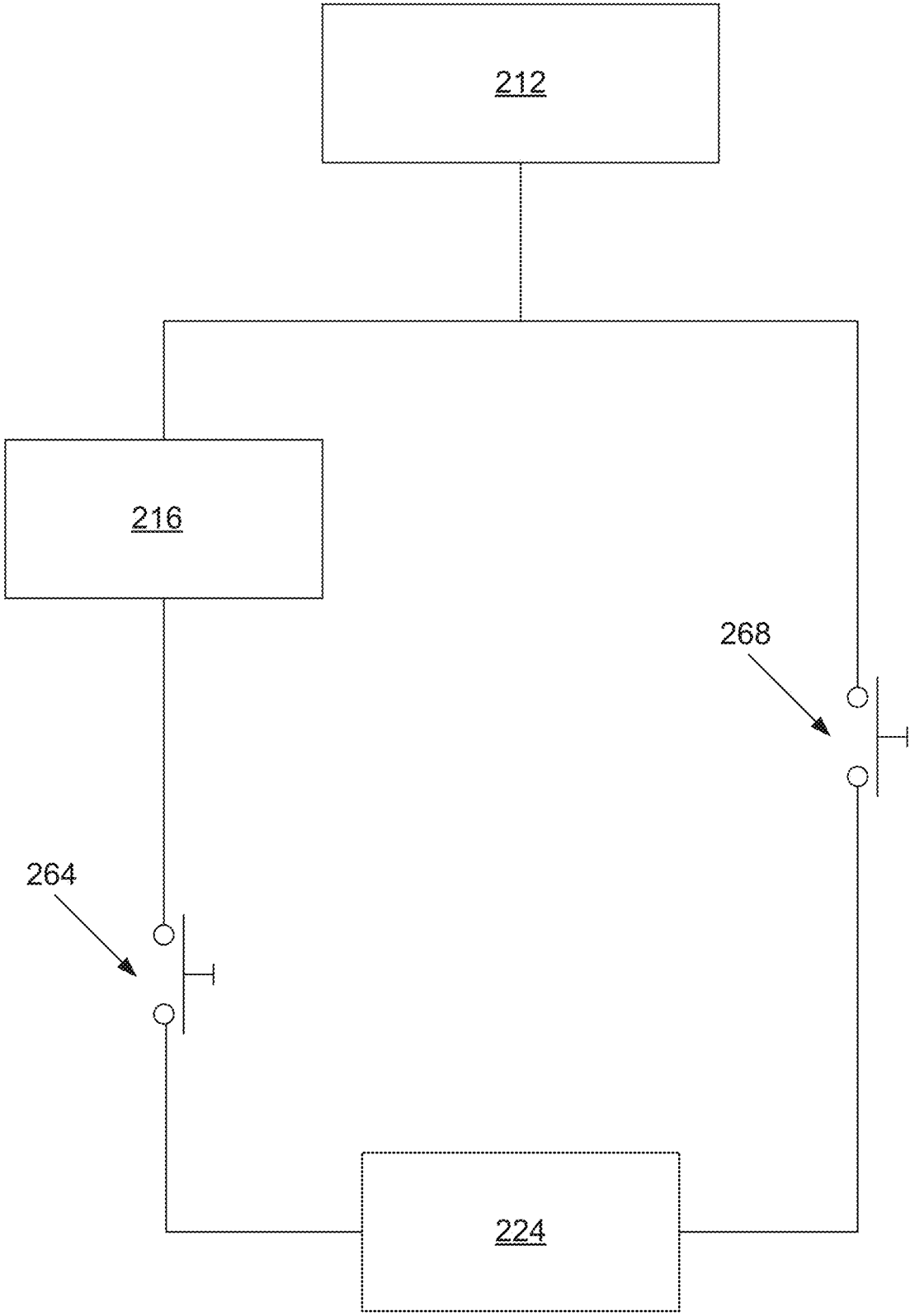
FIG. 7 depicts a simplified, schematic diagram of the switching components of the system of FIGS. 2A-2B.

FIG. 7 depicts a simplified, schematic diagram of the switching components of the system 200. In the embodiment shown, the switching components can be operatively coupled to pump drive 220 to control pumps 224. The switching components include a switch 264 and a bypass switch 268. In the embodiment shown, the switching components are MOSFETs but other suitable switching elements can be used. Switch 264 is disposed in series between VFD 216 and hydraulic pump 224 and bypass switch 268 is disposed in series between electric motor 212 and hydraulic pump 224 and in parallel with VFD 216. Control system 132 is configured to toggle switch 264 and bypass switch 268 between an ON and OFF state. When switch 264 is ON, switch 268 is OFF, and hydraulic pump 224 is coupled in series to VFD 216, which is coupled in series with electric motor 212. This configuration constitutes a VFD flow path by which electricity from VFD 216 is supplied to hydraulic pump 224. When bypass switch 268 is ON, switch 264 is OFF, and hydraulic pump 224 is coupled in series directly to electric motor 212. This configuration constitutes a bypass flow path by which electricity is supplied to hydraulic pump 224 directly from electric motor 212. Control system 132 operates switch 264 and bypass switch 268 in such a way that only one of the switches is ON at a time. For example, when switch 264 is ON, bypass switch 268 is OFF, and when switch 264 is OFF, bypass switch 268 is ON. In this way, control system 132 controls whether hydraulic pump 224 receives power directly from electric motor 212 or receives power regulated by VFD 216.

Each hydraulic pump 224 will have its own switch 264 and bypass switch 268. During a soft start operation, switch 264 is turned ON to enable hydraulic pump 224 to receive an amplitude of power gradually in a ramp up manner from VFD 212. As hydraulic pump 224 moves from a cold state to an operating speed, VFD 216 ramps up the power supplied to hydraulic pump 224 until it reaches an operating speed. At this point, switch 264 is turned OFF to disconnect hydraulic pump 224 from VFD 212 and bypass switch 268 is turned ON to enable hydraulic pump 224 to receive an amplitude of power directly from electric motor 212. Electric motor 212 operates at a constant speed that supplied sufficient horsepower to maintain hydraulic pump 224 at operating speed. Once the hydraulic pump 224 is at operating speed it is connected to electric motor 212 via bypass switch 268 and the motor continues to power the pump, without the help of the VFD, from that time onward or until the pump is turned off. Control system 132 actuates the switching components in the same manner for the next hydraulic pump. In this way, control system 132 sequentially actuates a soft start process in each of the hydraulic pumps by connecting one hydraulic pump at a time to VFD 216. In this manner, a single VFD 416 can actuate each hydraulic pump instead of providing a separate VFD for each hydraulic pump.

Figure 8:
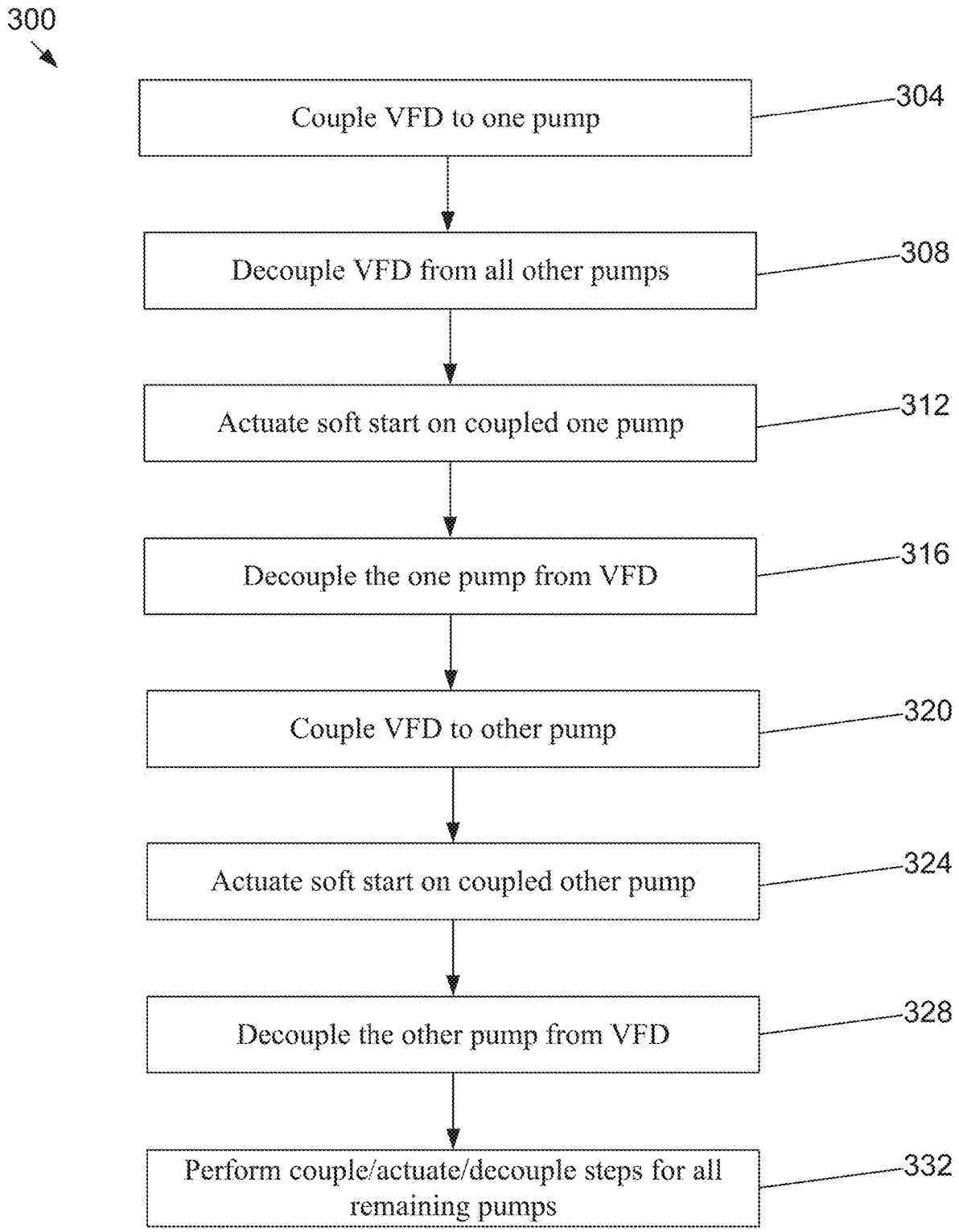
FIG. 8 depicts a flowchart of an exemplary method for operating the VFD and switching components of the system of FIGS. 2A-2B.

FIG. 8 depicts a flowchart of an exemplary method 300 for operating VFD 216 and switching components of the system 200. Referring to FIG. 8, method 300 begins by coupling VFD 216 to one of a plurality of hydraulic pumps 224 (step 304). Control system 132 switches switch 264 for the one hydraulic pump to an ON state and switches bypass switch 268 to an OFF state. This creates a VFD flow path and first state where the pump is powered by the electric motor and the amplitude of power provided by the electric motor to the pump is controlled by the VFD. Method 300 continues by decoupling VFD 216 from all other of the plurality of hydraulic pumps 224 (step 308). For example, control system 132 can switch all switches 264 and bypass switches 268 for all of the other hydraulic pumps to an OFF state, such that only the first pump is actuated by motor 212 via the VFD. After at least one pump 214 is running at operating speed, control system 132 can the bypass switch 268 for those operating speed pumps ON such that those pumps remain powered by motor 212 while the speed of a subsequent pump (e.g., 214) is ramped up via a combination of the VFD and motor. Method 300 continues by actuating a soft start process on the hydraulic pump 224 coupled to the VFD 216 (step 312). VFD 216 regulates electric motor 212 to ramp up power to actuate the hydraulic pump from a cold state to an operating state. Once the coupled hydraulic pump reaches operating speed, method 300 continues by decoupling the actuated hydraulic pump from VFD 216 (step 316). Control system 132 switches switch 264 for the one hydraulic pump to an OFF state and switches bypass switch 268 to an ON state. This creates a bypass flow path and second state where the pump is powered by the electric motor and the amplitude of power provided by the electric motor to the pump is not controlled by the VFD. Method 300 continues by coupling the VFD to another of the plurality of hydraulic pumps (step 320), actuating a soft start process on that hydraulic pump (step 324), and decoupling the actuated hydraulic pump from the VFD (step 328). Method 300 continues these steps sequentially for each of the plurality of hydraulic pumps until all of the hydraulic pumps are actuated and running at operating speed (step 332). In this state, the bypass switches 268 for each of the hydraulic pumps are ON and each hydraulic pump is receiving power directly from electric motor 212.

Figure 9:
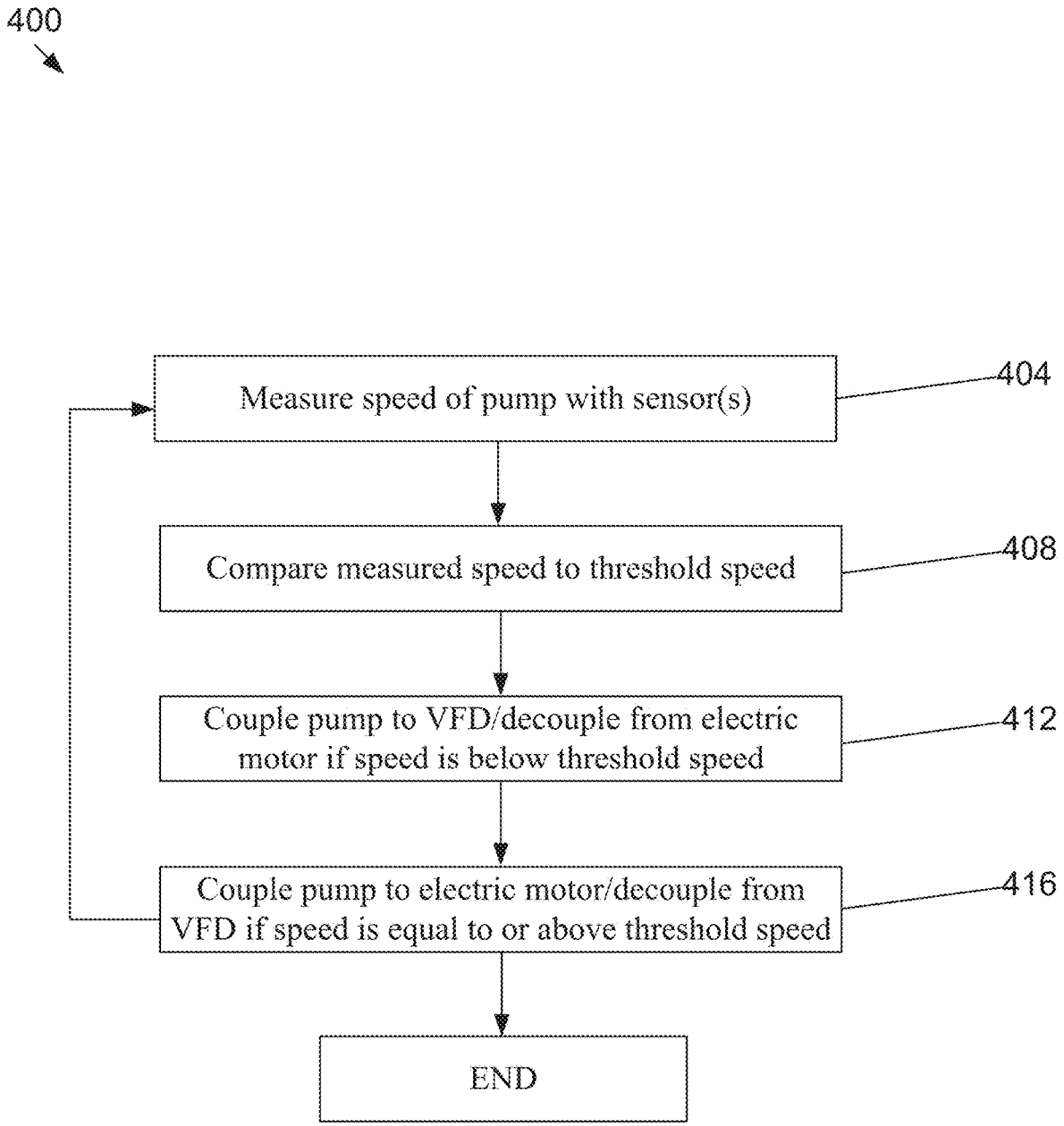
FIG. 9 depicts a flowchart of an exemplary algorithm for coupling and decoupling the VFD from the hydraulic pumps of the system of FIGS. 2A-2B.

FIG. 9 depicts a flowchart of an exemplary algorithm 400 for coupling and decoupling the VFD 216 from the hydraulic pumps 224 via pump drive 220. Instructions for executing the algorithm 400 can be stored in a memory of control system 132 and executed by a processor included as a part of control system 132. As discussed previously, data collected from sensor(s) can be stored in the memory and used by control system 132 to determine a timing for execution of certain steps of the algorithm 400. In the embodiment shown, algorithm 400 begins by measuring a speed of a hydraulic pump using data collected by sensor(s) and stored in a memory of control system 132 (step 404). Algorithm 400 continues by comparing the measured speed to a threshold speed (step 408). In the embodiment shown, the threshold speed corresponds to an operating speed of the hydraulic pump sufficient to supply hydraulic fluid to the well pump assembly. If the measured speed of the hydraulic pump is below the threshold speed, algorithm 400 continues by coupling the hydraulic pump to the VFD and decoupling the hydraulic pump from direct connection to the electric motor (step 412). In this way, the VFD can regulate the power supplied to the hydraulic pump until it reaches the threshold speed. If the measured speed of the hydraulic pump is equal to or above the threshold speed, algorithm 400 continues by decoupling the hydraulic pump from the VFD and coupling the hydraulic pump in direct connection to the electric motor (step 416). In this way, the electric motor can supply power to maintain the hydraulic pump at or above the threshold speed and the VFD can be made available to be coupled to another hydraulic pump. Algorithm 400 can then be executed repeatedly on the different hydraulic pumps until each pump reaches the threshold speed and is directly powered by the electric motor. At this point, algorithm 400 can end. This state corresponds to a fully operational state of the hydraulic pumps and the well pump assembly. In this way, the VFD is coupled to only one hydraulic pump at a time and only when the hydraulic pump is operating below the threshold speed. The VFD is sequentially connected to each hydraulic pump that is below the threshold speed until all of the hydraulic pumps are operating at or above the threshold speed.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments. For example, embodiments of the present methods and systems may be practiced and/or implemented using different structural configurations, materials, ionically conductive media, monitoring methods, and/or control methods.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A system for powering a pump, the system comprising:

a hydraulic pump;

an electric motor configured to power the hydraulic pump;

a variable frequency drive (VFD) configured to be coupled to the electric motor to control an amplitude of power provided by the electric motor to the hydraulic pump; and a control system configured to control the VFD between:

a first state, wherein the hydraulic pump is powered, in a ramp-up manner, by the electric motor, and the amplitude of power provided by the electric motor to the hydraulic pump is controlled by the VFD until the pump achieves an operating speed; and a second state, wherein the hydraulic pump is powered, at the operating speed, by the electric motor, and the amplitude of power provided by the electric motor to the hydraulic pump is not controlled by the VFD;

wherein the second state is maintained until the hydraulic pump is powered off.

2. The system according to claim 1, wherein the electric motor is a fixed speed electric motor.

3. The system according to claim 1, further comprising at least one electric generator coupled to the electric motor.

4. The system according to claim 1, wherein the control system comprises an electric circuit having:

a VFD flow path that, in the first state, allows the VFD to control the amplitude of power provided by the electric motor to the hydraulic pump; and a bypass flow path that, in the second state, does not allow the VFD to control the amplitude of power provided by the electric motor to the hydraulic pump.

5. The system according to claim 4, wherein the electric circuit comprises a plurality of switches actuatable to selectively permit electricity to flow through the VFD flow path and the bypass flow path.

6. The system according to claim 5, wherein the control system is configured to control the plurality of switches.

7. The system according to claim 1, wherein the hydraulic pump is a variable flow rate pump.

8. The system according to claim 1, wherein the hydraulic pump is a fixed displacement pump.

9. The system according to claim 1, wherein the hydraulic pump is coupled to a pump drive and a hydraulic ram cylinder.

10. The system according to claim 9, wherein the hydraulic ram cylinder and the electric motor are disposed on a first vehicle.

11. The system according to claim 10, wherein the VFD is disposed on a second vehicle.

12. The system according to claim 9, wherein the hydraulic ram cylinder has a ram cylinder housing, a ram piston configured to reciprocate in the ram cylinder housing, and a piston rod coupled to the ram piston and a plunger rod of a working fluid end cylinder such that the piston is actuated to move the plunger rod:

in a first direction to expel working fluid from a housing of the working fluid end cylinder during a forward stroke of the plunger rod, and in a second direction to draw working fluid into the housing during a return stroke of the plunger rod.

13. The system according to claim 1, further comprising:

at least one working fluid end cylinder having an end cylinder housing and a plunger rod configured to reciprocate in the end cylinder housing;

at least one inlet check valve coupled to the end cylinder housing and at least one outlet check valve coupled to the end cylinder housing;

a suction manifold having at least one fluid inlet coupled to the at least one inlet check valve; and a discharge manifold having at least one fluid outlet coupled to the at least one outlet check valve.

14. The system of claim 1, wherein the control system is configured to control the VFD such that the second state is maintained until the pump achieves a speed of zero.

* * * * *